US007409182B2

(12) United States Patent
Ishii

(10) Patent No.: US 7,409,182 B2
(45) Date of Patent: Aug. 5, 2008

(54) BRUSH MEMBER AND TRANSFER DEVICE AND IMAGE FORMING APPARATUS USING THE SAME

(75) Inventor: Hirokazu Ishii, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 63 days.

(21) Appl. No.: 11/420,402

(22) Filed: May 25, 2006

(65) Prior Publication Data

US 2007/0014597 A1 Jan. 18, 2007

(30) Foreign Application Priority Data

Jul. 15, 2005 (JP) ..... 2005-207197

(51) Int. Cl.
*G03G 15/20* (2006.01)

(52) U.S. Cl. ..... 399/313; 399/310

(58) Field of Classification Search ..... 399/302, 399/303, 308, 310, 313, 314
See application file for complete search history.

(56) References Cited

U.S. PATENT DOCUMENTS 5,233,395 A * 8/1993 Kohyama ..... 399/314
5,249,022 A * 9/1993 Watanabe et al. ..... 399/303
5,428,429 A * 6/1995 Fletcher ..... 399/308
5,515,146 A 5/1996 Harasawa et al.
5,631,725 A 5/1997 Harasawa et al.
5,678,149 A * 10/1997 Takekoshi et al. ..... 399/310 X
5,812,919 A 9/1998 Takano et al.
5,822,667 A 10/1998 Hayama et al.
5,930,573 A 7/1999 Miyamoto et al.
5,978,638 A * 11/1999 Tanaka et al. ..... 399/302
6,006,062 A * 12/1999 Takahashi et al. ..... 399/310
6,188,862 B1 2/2001 Ishii
6,212,351 B1 * 4/2001 Kawagoe et al. ..... 399/302
6,282,386 B1 8/2001 Ishii
6,697,583 B2 2/2004 Ishii
6,731,899 B2 * 5/2004 Takahata et al. ..... 399/302
6,778,802 B2 8/2004 Kabata et al.
6,813,467 B2 11/2004 Kawahara et al.
6,895,209 B2 5/2005 Kawahara et al.
6,961,535 B2 11/2005 Kawahara et al.

(Continued)

FOREIGN PATENT DOCUMENTS

JP 9-281768 10/1997

(Continued)

*Primary Examiner*—Sandra L Brase
(74) *Attorney, Agent, or Firm*—Oblon, Spivak, McClelland, Maier & Neustadt, P.C.

(57) ABSTRACT

In an image forming apparatus, a transfer brush with length of raised bristles on the surface of a metal holder equal to or smaller than 5.8 millimeters is used. Alternatively, a transfer brush with a maximum bristle inclination amount of raised bristles in a brush unit including a plurality of bristles equal to or smaller than 0.53 millimeter or a transfer brush with a maximum bristle inclination return amount of raised bristles in the brush unit equal to or smaller than 0.30 millimeter is used. An amount of biting into a paper conveyor belt in the brush unit is set to a value equal to or smaller than 2.5 millimeters. A paper conveyor belt with hardness of the rear side equal to or lower than 78 Hs is used. Alternatively, a paper conveyor belt with a coefficient of static friction on the rear surface equal to or lower than 0.75 is used.

15 Claims, 6 Drawing Sheets

U.S. PATENT DOCUMENTS

2005/0180767 A1 8/2005 Ishii et al.

FOREIGN PATENT DOCUMENTS

| | | |
|---|---|---|
| JP | 2000-347511 | 12/2000 |
| JP | 2001-154499 | 6/2001 |
| JP | 2001-154505 | 6/2001 |
| JP | 2001-331047 | 11/2001 |
| JP | 2002-123124 | 4/2002 |
| JP | 2002-169418 | 6/2002 |
| JP | 2002-244455 | 8/2002 |

* cited by examiner

FIG.11

| MATERIAL | | NYLON 6 | | | NYLON 12 | |
|---|---|---|---|---|---|---|
| CONDUCTIVE MATERIAL | | CARBON | | | CARBON | |
| STRUCTURE | | UNIFORMLY DISTRIBUTED TYPE | | | COMPLEX TYPE | |
| CARBON DISTRIBUTION STATE | | 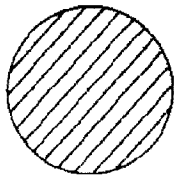 MODIFIED CROSS-SECTION YARN IS ALSO PRESENT | | | 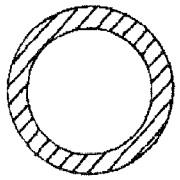 | |
| TOTAL FINENESS | T/F | 330/48 | 220/96 | 220/192 | 320/48 | 107/48 |
| SINGLE YARN FINENESS | T | 6.9 | 2.3 | 1.1 | 6.7 | 2.2 |
| SINGLE YARN DIAMETER | Φ μm | Φ27 | Φ15 | Φ11 | Φ28 | Φ16 |
| SPECIFIC GRAVITY | | 1.26 | | | 1.06 | |
| MELTING POINT | | 220℃ | | | 180℃ | |
| SOFTENING POINT | | 190℃ | | | 150℃ | |
| TENSILE STRENGTH | | 1.1～1.3 | | | 1.2～3.2 | |
| YOUNG'S MODULUS | N/mm | 900～1000 | | | 1500～2100 | |
| MOISTURE CONTENT | OFFICIAL | 4.5% | | | 1.2% | |
| | 20℃65%RH | 3.5～5.0% | | | 1.2% | |
| | 20℃95%RH | 8.0～9.0% | | | 1.5% | |

BRUSH MEMBER AND TRANSFER DEVICE AND IMAGE FORMING APPARATUS USING THE SAME

CROSS-REFERENCE TO RELATED APPLICATIONS

The present document incorporates by reference the entire contents of Japanese priority document, 2005-207197 filed in Japan on Jul. 15, 2005.

BACKGROUND OF THE INVENTION

1. Field of the Invention

The present invention relates to a brush member used in a transfer device that transfers, while supplying a transfer bias to a rear surface of a moving belt member using the brush member, a visible image on the surface of a latent image bearing member onto a front surface of the belt member or a transfer material held on the front surface. The present invention also relates to transfer devices and image forming apparatuses like a copying machine, a facsimile apparatus, and a printer that use such a brush member.

2. Description of the Related Art

Conventionally, in the image forming apparatuses of this type, in general, a transfer brush that has a predetermined electric resistance in a conductive brush unit including a plurality of raised bristles vertically provided on the surface of a metal support plate is used as a transfer brush serving as the brush member. As such image forming apparatuses, those disclosed in Japanese Patent Application Laid-Open Nos. 2000-347511, 2001-154499, 2001-331047, 2002-123124, 2002-169418, H9-281768, and the like are known. As the raised bristles forming the brush unit, raised bristles made of conductive rayon or nylon are used as disclosed in Japanese Patent Application Laid-Open No. H9-281768.

In the image forming apparatuses with such a constitution, shavings of the rear surface of the belt member due to rubbing of the belt member against the transfer brush accumulate on a brush tip of the transfer brush. The shavings change a frictional force of the transfer brush and the belt member to irregularly fluctuate a linear velocity of the belt member. This tends to cause transfer blurring in a transfer image.

SUMMARY OF THE INVENTION

The present invention is proposed to cope with the aforementioned problems, and it is an object of the present invention to at least partially solve the problems in the conventional technology.

According to one aspect of the present invention, a transfer device includes: a belt device that endlessly moves a belt member of an endless shape while stretching and suspending the belt member with a plurality of stretching and suspending members; and a brush member disposed to bring a tip side of a brush unit including a plurality of raised bristles vertically provided on a surface of a conductive support member into contact with a rear surface, or a loop inner side surface, of the belt member, wherein the transfer device transfers a visible image on a surface of a latent image bearing member in contact with a front surface of the belt member onto the front surface of the belt member or a transfer material held on the front surface while leading a transfer bias applied to the conductive support member from the tip side of the brush unit to the rear surface of the belt member, and wherein the brush unit of the brush member is constructed such that at least one of a length of the raised bristles on the surface of the conductive support member, a maximum bristle inclination amount of the raised bristles and a maximum bristle inclination return amount of the raised bristles in the brush unit is predetermined.

According to another aspect of the present invention, a transfer device includes: a belt device that endlessly moves a belt member of an endless shape while stretching and suspending the belt member with a plurality of stretching and suspending members; and a brush member disposed to bring a tip side of a brush unit including a plurality of raised bristles vertically provided on a surface of a conductive support member into contact with a rear surface, or a loop inner side surface, of the belt member, wherein the transfer device transfers a visible image on a surface of a latent image bearing member in contact with a front surface of the belt member onto the front surface of the belt member or a transfer material held on the front surface while leading a transfer bias applied to the conductive support member from the tip side of the brush unit to the rear surface of the belt member, and wherein at least one of an amount of biting into the belt member in the brush unit of the brush member, hardness of the rear surface side of the belt member and a coefficient of static friction on the rear surface of the belt member is predetermined.

According to still another aspect of the present invention, an image forming apparatus includes the transfer device which is constructed in either one of the above-mentioned structures.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 11 is a table of various properties of nylon 6 and nylon 12.

DETAILED DESCRIPTION OF THE PREFERRED EMBODIMENTS

Exemplary embodiments of the present invention are explained in detail below with reference to the accompanying drawings.

Figure 1:
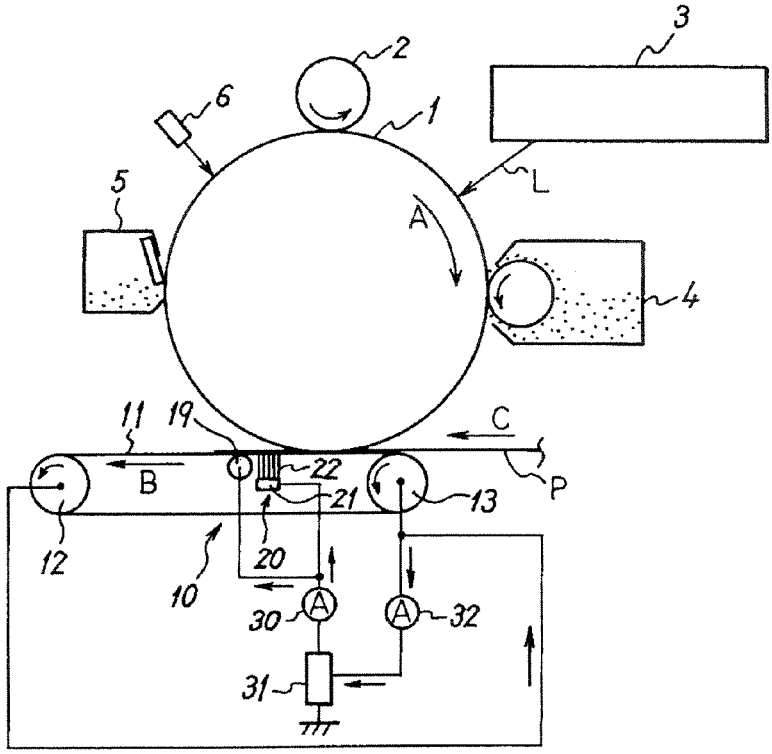
FIG. 1 is a schematic of a printer according to a first embodiment of the present invention.

FIG. 1 is a schematic of a printer according to a first embodiment of the present invention. In the figure, a charging roller 2, an optical writing unit 3, a developing device 4 serving as a developing unit, a transfer device 10, a drum cleaning device 5, an electricity removing lamp 6, and the like are disposed around a drum-like photosensitive member 1 serving as a latent image bearing member.

The photosensitive member 1 is driven to rotate in a clockwise direction in the figure (a direction of an arrow A in the figure) by a not-shown driving unit. The photosensitive member 1 is uniformly charged to a minus polarity in the dark by the charging roller 2 to which a charging bias is applied by a not-shown power supply. A surface potential of the photosensitive member 1 after the uniform charging is, for example, −800 volts. On the surface of the photosensitive member 1 in such a potential state, an electrostatic latent image corresponding to an image signal is formed by optical scanning by an optically modulated laser beam L irradiated from the optical writing unit 3 serving as a latent image forming unit. A surface potential of a portion of the electrostatic latent image is, for example, −130 volts. A surface potential of other background portions remains unchanged at −800 volts.

A toner charged to a minus polarity is deposited on the electrostatic latent image formed on the photosensitive member 1 by the developing device 4 serving as a developing unit. The electrostatic latent image on the photosensitive member 1 is developed to be a toner image, which is a visible image, according to the deposition of the toner. The toner image is transferred onto transfer paper P serving as a transfer material by the transfer device 10. After a transfer residual toner is removed from the surface of the photosensitive member 1 after the transfer by the drum cleaning device 5, the surface is subjected to electricity removal by the electricity removing lamp 6.

The transfer device 10 includes a belt device including a paper conveyor belt 11 serving as an endless belt member, a driving roller 12, and a driven roller 13 and a transfer bias device including a transfer roller 19, a transfer brush 20, and a transfer bias power supply 31.

The belt device endlessly moves the paper conveyor belt 11 in a counterclockwise direction (an arrow B direction) in the figure with the driving roller 12, which is driven to rotate by a not-shown driving unit, while stretching and suspending the paper conveyor belt 11 with the driving roller 12 and the driven roller 13. The belt device brings a front surface of a belt spreading and stretching place between the driving roller 12 and the driven roller 13 into contact with the photosensitive member 1 to form a transfer nip.

The transfer roller 19 of the transfer bias device is made of metal like stainless steel and disposed to rotate while coming into contact with the rear surface of the paper conveyor belt 11. A place of this contact is the belt spreading and stretching place between the driving roller 12 and the driven roller 13 and is a place further on a downstream side in a belt moving direction than the transfer nip.

The transfer brush 20 of the transfer bias device includes a metal holder 21 serving as a conductive support member and a brush unit 22 including a plurality of raised bristles fixed to the surface of the metal holder 21 by a conductive adhesive. The transfer brush 20 is disposed to bring a tip side of the brush unit 22 into contact with the rear surface of the paper conveyor belt 11. A place of this contact is the belt spreading and stretching place between the driving roller 12 and the driven roller 13 and is a place further on an upstream side in the belt moving direction than the transfer roller 19.

In the transfer brush 20, a transfer bias power supply 31 is connected to the metal holder 21 made of stainless steel or the like via a first ampere meter 30. On the other hand, a roller unit of the driven roller 13, which stretches and suspends the paper conveyor belt 11 while supporting the same on the rear surface thereof, is made of metal such as stainless steel. An electric wire is connected to a metal shaft member of the driven roller 13 via a not-shown rubbing contact. An electric wire is also connected to a metal shaft member of the driving roller 12, which stretches and suspends the paper conveyor belt 11 while supporting the same on the rear surface thereof, via a not-shown rubbing contact. The electric wire extending from the shaft member of the driven roller 13 and the electric wire extending from the shaft member of the driving roller 12 are connected to each other and, then, connected to the transfer bias power supply 31 via a second ampere meter 32.

A part of electric charges flowing from the transfer bias power supply 31 to the paper conveyor belt 11 via the first ampere meter 30, the metal holder 21, and the brush unit 22 moves in a belt circumferential direction on the rear surface of the paper conveyor belt 11 and reaches the driving roller 12 and the driven roller 13. The electric charge flows from the driving roller 12 and the driven roller 13 to a ground via the second ampere meter 30 and the transfer bias power supply 3. The remainder of the electric charges flowing from the brush unit 22 to the paper conveyor belt 11 moves in a thickness direction in the paper conveyor belt 11 and flows to the photosensitive member 1. A current value due to this flow of the electric charges, that is, a transfer current value, is substantially the same as a value calculated by subtracting a current measurement value measured by the second ampere meter 32 from a current measurement value measured by the first ampere meter 30.

The transfer bias power supply 31 includes a not-shown constant current control circuit. The transfer bias power supply 31 changes an output voltage value using the constant current control circuit such that the value calculated by subtracting the current measurement value measured by the second ampere meter 32 from the current measurement value measured by the first ampere meter 30, that is, the transfer current value, is stabilized at a predetermined target value. The transfer current value during an image forming operation is kept substantially constant by such control (hereinafter, "constant current control").

In the paper conveyor belt 11, a surface layer made of conductive resin is formed on a front surface side of a belt substrate made of conductive rubber. A surface resistivity on a rear surface side thereof is adjusted to $10^7$ Ω/□ to $10^{10}$ Ω/□ in JISK6911. A surface resistivity on the front surface side is adjusted to $10^8$ Ω/□ to $10^{13}$ Ω/□ in JISK6911. A volume specific resistivity of the belt substrate is adjusted to $10^7$ Ω/□ to $10^{11}$ Ω/□ in JISK6911.

A sheet feeding unit is disposed in a not-shown area. The sheet feeding unit sends the transfer paper P serving as a transfer material in an arrow C direction in the figure at timing when the transfer paper P can be put on a toner image on the photosensitive member 1 using the transfer nip. The transfer paper P sent enters the transfer nip while being held on an upper stretching and suspending surface in the paper conveyor belt 11 of the transfer device 10. The toner image on the photosensitive member 1 is transferred onto the transfer paper P according to influences of the transfer current and a nip pressure.

The transfer paper P having the toner image transferred thereon is passed to a fixing device disposed in a not-shown area further on a left side in the figure than the transfer device 10. The transfer paper P is subjected to fixing processing for the toner image and, then, discharged to the outside of the apparatus.

Figure 2:
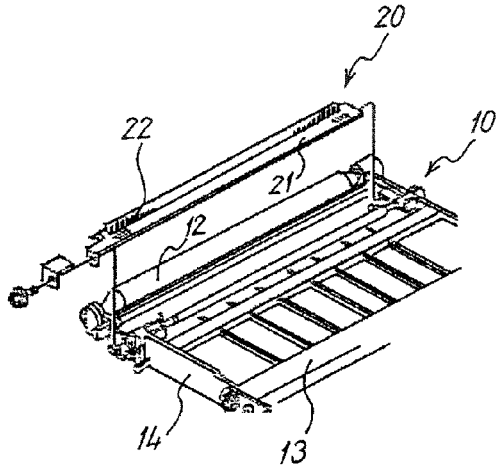
FIG. 2 is a disassembled perspective view of a part of a transfer device of the printer.
Figure 3:
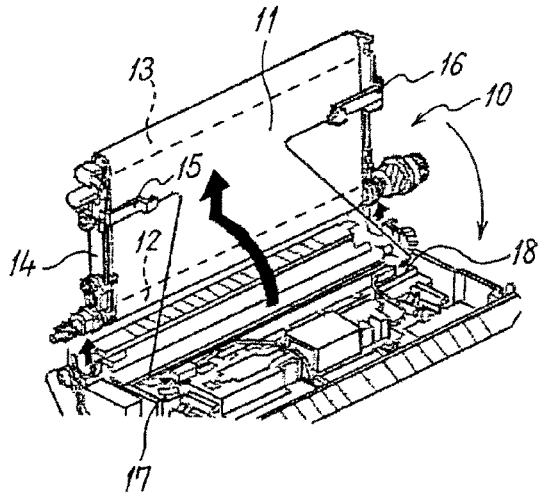
FIG. 3 is a perspective view of a part of the transfer device and a housing of the printer.

FIG. 2 is a disassembled perspective view of a part of the transfer device 10. In the figure, the transfer device 10 has a roller support member 14 that rotatably supports the driving roller 13 and the driven roller 13 at both ends thereof, respectively. The transfer brush 20 is screwed and fixed to the roller support member 14 on which the paper conveyor belt 11 is not mounted. The paper conveyor belt 11 is laid around the roller support member 14 after the transfer brush 20 is screwed and fixed thereto. As shown in FIG. 3, not-shown one end sides of a first bias terminal 15 and a second bias terminal 16 of metal are fixed to the roller support member 14 around which the paper conveyor belt 11 is laid. The metal holder 21 of the transfer brush 10 is electrically connected to a not-shown fixed side end of the first bias terminal 15 on an inner side of a loop of the paper conveyor belt 11. A not-shown fixed side end of the second bias terminal 16 is connected to the metal shaft member of the driven roller 13 on the inner side of the loop of the paper conveyor belt 11.

As shown in FIG. 3, free end sides of the first bias terminal 15 and the second bias terminal 16 are opposed to a lower stretching and suspending surface of the paper conveyor belt 11 via a predetermined space. When the transfer device 10 to which these bias terminals are fixed is mounted on a printer body as indicated by an arrow in FIG. 3, the first bias terminal 15 is brought into close contact with a first contact terminal 17 fixed to the printer body side. The second bias terminal 16 is brought into close contact with a second contact terminal 18 fixed to the printer body side. The first contact terminal 17 is connected to the transfer bias power supply 31 via the first ampere meter 30 shown in FIG. 1. The second contact terminal 18 is connected to the ground via the second ampere meter 32 and the transfer bias power supply 31.

The inventor carried out an experiment described below as a first experiment. First, the inventor prepared various kinds of transfer brushes as the transfer brushes 20. The transfer brushes 20 have the same constitution except that materials of raised bristles forming the brush unit 22 are different. The transfer brushes 20 adopt a form shown in FIGS. 4 and 5.

Figure 4:
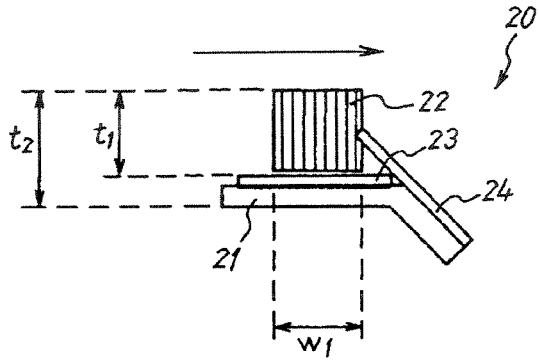
FIG. 4 is a side view of a transfer brush of the transfer device.

FIG. 4 is a side view of the transfer brush 20. In the figure, respective raised bristles forming the brush unit 22 of the transfer brush 20 are fixed to the metal holder 21 of stainless steel (SUS304) via a conductive couple-face tape 23. The conductive couple-face tape 23 is made of a material that displays electric conductivity substantially equal to that of metal. A pile length t1, which is a projection amount of the respective raised bristles from the upper surface of the conductive couple-face tape 23, is different depending upon a kind of the transfer brush 20. Thickness t2 from the tip of the brush unit 22 including the raised bristles to the rear surface of the metal holder 21 is also different according to the pile length t1. A brush width W1, which is a dimension in a latitudinal direction (equivalent to the belt moving direction) of the brush unit 22, is set to 5 millimeters. A plate member 24 made of an insulative material is cantilever-fixed to the metal holder 21. A free end of the plate member 24 is in contact with one end side in the latitudinal direction of the brush unit 22. The plate member 24 prevents the brush unit 22, the tip of which is in contact with the rear surface of a not-shown paper conveyor belt, from excessively bending the respective raised bristles following the movement of the paper conveyor belt in an arrow direction in the figure. The free end is in contact with the brush unit 22 in a position lower than the tip of the brush by about 2 millimeters.

Figure 5:
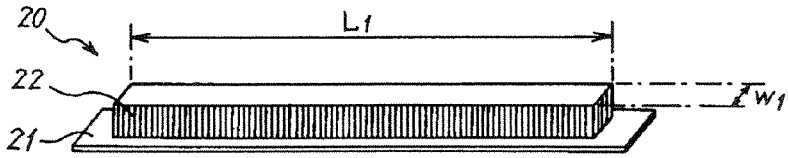
FIG. 5 is a perspective view of the transfer brush.

FIG. 5 is a perspective view of the transfer brush 20. A brush length L1, which is a dimension in a longitudinal direction (equivalent to a belt width direction) of the brash unit 22, is set to 297.5 millimeters. The brush width W1 is 5 millimeters as described above. The inventor prepared a plurality of transfer brushes 20 that have dimensions shown in FIGS. 4 and 5 and different materials and lengths of raised bristles. Raised bristles forming the brush units 22 of the transfer brushes 20 are made of a material obtained by dispersing carbon powder serving as a conductive electric resistance in a rayon base material or a nylon (nylon 6) base material. The transfer brush 20 using raised bristles made of the material obtained by dispersing the carbon powder in the rayon base material is hereinafter referred to as the transfer brush 20 of rayon. The transfer brush 20 using raised bristles made of the material obtained by dispersing the carbon powder in the nylon base material is hereinafter referred to as the transfer brush 20 of nylon.

Rayon refers to reproduced fiber obtained by dissolving cellulose into a colloid solution and drawing out the cellulose from pores into a coagulating liquid. Nylon refers to fiber that is arbitrary long-chain synthetic polyamide, a main chain of which has repetition of an amide group and structure units of which are arranged in an axial direction.

The inventor measured the pile length t1 for all the transfer brushes 20 prepared using a scale in a state immediately after manufacturing in which the respective raised bristles stood straight up. Subsequently, the inventor prepared a printer test machine having the same constitution as the printer shown in FIG. 1. After attaching one of the transfer brushes 20 prepared in advance to the printer test machine, the inventor outputted a test image on 100,000 pieces of transfer paper. After outputting the test image, the inventor removed the paper conveyor belt 11 from the printer test machine and visually checked whether shaving due to rubbing against the transfer brush 20 on the rear surface of the paper conveyor belt 11 occurred. By way of precaution, the inventor checked whether shavings of the rear surface of the paper conveyor belt 11 adhered to the tip of the transfer brush 20. The inventor also checked whether transfer blurring occurred in a printout image. A result of the experiment is shown in Table 1 below. The output of the test image was performed in an L/L environment (an environment of 10° C. and 15% RH) in which a bristle inclination amount described later was relatively small. The number of outputs of the test image was set to 100,000 because it was known in advance that, when transfer blurring due to accumulation of shavings of the belt rear surface on the tip of the transfer brush 20 occurred, the transfer blurring surely occurred if printout of 100,000 images was performed. As the test image, the inventor outputted an image with a 2×2 solid halftone section formed on entire transfer paper to transfer paper of the A3 size. As the paper conveyor belt 11, the inventor used a paper conveyor belt, a hardness measurement value on the rear surface side of which measured by a spring type JIS hardness meter (an A-type hardness meter (JA type)) complying with the standard of JIS K 6301 was 78 Hs.

TABLE 1

| | Pile length t1 [mm] | | | | | |
|---|---|---|---|---|---|---|
| | 5.0 | 5.3 | 5.5 | 5.8 | 6.0 | 6.2 |
| Belt shaving | No | No | No | No | Yes | Yes |
| Transfer blurring | No | No | No | No | Yes | Yes |

As shown in Table 1, it is seen that, when the pile length t1 was equal to or smaller than 5.8 millimeters, shaving of the rear surface of the paper conveyor belt 11 due to rubbing against the transfer brush 20 did not occur and, as a result, transfer blurring did not occur either. Thus, the printer according to the first embodiment is mounted with a transfer brush with the pile length t1 equal to or smaller than 5.8 millimeters as the transfer brush 20.

A printer according to a second embodiment of the present invention has the same constitution as that in the first embodiment unless specifically noted otherwise.

Figure 6:
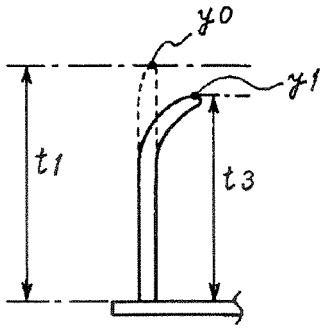
FIG. 6 is a schematic for explaining a bristle inclination amount of raised bristles.

In a second experiment, as in the first experiment, the inventor prepared various kinds of transfer brushes as the transfer brushes 20. The inventor measured bristle inclination amounts of the respective transfer brushes 20. A method of measuring the bristle inclination amounts is as described below. First, three transfer brushes 20 are prepared for each kind of the transfer brushes 20. The entire surface of the tip in one of the three transfer brushes of the same kind is brought into contact with a stainless steel plate with a biting amount of 1.5 millimeters. The biting amount refers to a value obtained by subtracting a distance between the upper surface of the metal holder 21 of the transfer brush 20 and the stainless steel plate, with which the transfer brush is brought into contact, from the pile length t1 shown in FIG. 4. After the tip of the transfer brush 20 is brought into contact with the stainless steel plate with the biting amount of 1.5 millimeters, the transfer brush 20 is left for twenty-four hours under an L/X environment (an environment of 10° C. and 30% RH to 40% RH). Then, as shown in FIG. 6, a bending crease is left at the tip of the raised bristle of the transfer brush 20. Length after bristle inclination t3 is measured by a scale. The length after bristle inclination t3 is a distance between a point y1 that is a position in a Y direction in the figure (an upright direction of the raised bristles) at the tip of the raised bristle having the bending crease and a root of the raised bristle. When there is no bending crease, the point y1 is in the same position as a point y0 that is a tip position of the raised bristle extending straight. The length after bristle inclination t3 is equal to the pile length t1. However, usually, since a bending crease is left, the length after bristle inclination t3 is smaller than the pile length t1. A value calculated by subtracting the length after bristle inclination t3 from the pile length t1 is set as a bristle inclination amount under the L/X environment. Subsequently, after a second one of the three transfer brushes 2 of the same kind is brought into contact with the stainless steel plate with a biting amount of 1.5 millimeters and left for twenty-four hours under an N/N environment (an environment of 23° C. and 65% RH), the length after bristle inclination t3 is measured. A value calculated by subtracting the length after bristle inclination t3 from the pile length t1 is set as a bristle inclination amount under the N/N environment. After a third one of the three transfer brushes 2 of the same kind is brought into contact with the stainless steel plate with a biting amount of 1.5 millimeters and left for twenty-four hours under an H/N environment (an environment of 32° C. and 80% RH), the length after bristle inclination t3 is measured. A value calculated by subtracting the length after bristle inclination t2 from the pile length t1 is set as a bristle inclination amount under the H/H environment. A largest value among the bristle inclination amounts under the three environments is set as a maximum bristle inclination amount. A result of measuring such maximum bristle inclination amounts for all the kinds of the transfer brushes 20 is shown in Table 2 below.

TABLE 2

| Raised bristle material | Bristle inclination amount under L/X environment [mm] | Bristle inclination amount under N/N environment [mm] | Bristle inclination amount under H/H environment [mm] | Maximum bristle inclination amount [mm] |
|---|---|---|---|---|
| Rayon | 0.35 | 0.75 | 0.85 | 0.85 |
| Nylon | 0.20 | 0.48 | 0.53 | 0.53 |
| Nylon | 0.15 | 0.19 | 0.39 | 0.39 |

* L/X = 10° C., 30% RH to 40% RH
N/N = 23° C., 65% RH
H/H = 32° C., 80% RH

As shown in Table 2, it is seen that the transfer brushes 20 of nylon had small maximum bristle inclination amounts compared with that of nylon. Although not shown in Table 2, in both the two kinds of the transfer brushes 20 of nylon in Table 2, shaving of the rear surface of the paper conveyor belt 11 and transfer blurring did not occur even if the test image was printed on 100,000 pieces of transfer paper. On the other hand, in the transfer brush 20 of rayon, shaving of the rear surface of the paper conveyor belt 11 and transfer blurring occurred while the test image was printed on 100,000 pieces of transfer paper. Consequently, it was found that shaving of the rear surface of the paper conveyor belt 11 due to rubbing against the transfer brush 20 and transfer blurring due to accumulation of shavings on the brush tip could be controlled by using, as the transfer brush 20, a transfer brush with a maximum bristle inclination amount equal to or smaller than the maximum bristle inclination amount of 0.53 millimeter of nylon in Table 2. Therefore, in the printer according to the second embodiment, a transfer brush with a maximum bristle inclination amount equal to or smaller than 0.53 millimeter is used as the transfer brush 20.

A printer according to a third embodiment of the present invention has the same constitution as the printer according to the first embodiment unless specifically noted otherwise.

The inventor carried out an experiment for measuring a bristle inclination return amount of the various kinds of the transfer brushes 20 as a third experiment in parallel with the second experiment. Specifically, a method of the experiment is as described below. After measuring a bristle inclination amount of each kind of the transfer brushes 20, the transfer brush 20 is left for twenty-four hours under the same environment as the environment in the measurement of a bristle inclination amount without bringing the brush tip into contact with the stainless steel plate. Then, usually, since a raised bristle recovers a little from a bending crease at the tip thereof, the length after bristle inclination t3 is long compared with that immediately after the contact with the stainless steel plate. In the experiment, a value calculated by subtracting the length after bristle inclination t3 immediately after bringing the brush tip into contact with the stainless steel plate and leaving the transfer brush 20 for twenty-four hours from the length after bristle inclination t3 immediately after leaving the transfer brush 20 without bringing the brush tip into contact with the stainless steel plate was calculated as a bristle inclination return amount. A maximum value of bristle inclination return amounts calculated under the respective environments was set as a maximum bristle inclination return amount. A result of measuring such a maximum bristle inclination return amount for all the kinds of the transfer brushes 20 is shown in Table 3 below.

TABLE 3

| Raised bristle material | Bristle inclination return amount under L/X environment [mm] | Bristle inclination return amount under N/N environment [mm] | Bristle inclination return amount under H/H environment [mm] | Maximum bristle inclination return amount [mm] |
|---|---|---|---|---|
| Rayon | 0.13 | 0.35 | 0.40 | 0.40 |
| Nylon | 0.05 | 0.15 | 0.30 | 0.30 |
| Nylon | 0.08 | 0.10 | 0.30 | 0.30 |

* L/X = 10° C., 30% RH to 40% RH
N/N = 23° C., 65% RH
H/H = 32° C., 80% RH

As shown in Table 3, whereas maximum bristle inclination return amounts in the transfer brushes 20 of nylon were 0.30, a maximum bristle inclination return amount in the transfer brush 20 of rayon was 0.40. Consequently, it is seen that bristle inclination does not easily return to the original state in the transfer brushes 20 of nylon compared with that of rayon. Although not shown in Table 3, as described above, whereas shaving of the rear surface of the paper conveyor belt 11 and transfer blurring did not occur in both the two kinds of transfer brushes 20 of nylon, shaving of the rear surface of the paper conveyor belt 11 and transfer blurring occurred in the transfer brush 20 of rayon. Consequently, it was found that shaving of the rear surface of the paper conveyor belt 11 due to rubbing against the transfer brush 20 and transfer blurring due to accumulation of shavings on the brush tip could be controlled by using, as the transfer brush 20, a transfer brush with a maximum bristle inclination return amount equal to or smaller than the maximum bristle inclination return amount of 0.30 millimeter of nylon in Table 3. Therefore, in the printer according to the third embodiment, a transfer brush with a maximum bristle inclination return amount equal to or smaller than 0.30 millimeter is used as the transfer brush 20.

A printer according to a fourth embodiment of the present invention has the same constitution as that of the printer according to the first embodiment unless specifically noted otherwise.

As a fourth experiment, while changing a biting amount of the transfer brush 20 set in the printer test machine to various values, the inventor printed out the test image on 100,000 pieces of transfer paper with the respective biting amounts. The inventor removed the paper conveyor belt 11 from the printer test machine and visually checked whether shaving due to rubbing against the transfer brush 20 on the rear surface of the paper conveyor belt 11 occurred. By way of precaution, the inventor checked whether shavings of the rear surface of the paper conveyor belt 11 adhered to the tip of the transfer brush 20. The inventor also checked whether transfer blurring occurred in a printout image. A result of the experiment is shown in Table 4 below. A method of measuring an amount of biting of the transfer brush 20 into the paper conveyor belt 11 is the same as the method of measuring a biting amount in the second experiment except that the stainless steel plate is replaced with the paper conveyor belt 11. The output of the test image was performed in the L/L environment (an environment of 10° C. and 15% RH) in which a bristle inclination amount described later was relatively small. As the paper conveyor belt 11, the inventor used a paper conveyor belt, a hardness measurement value on the rear surface side of which measured by the spring type JIS hardness meter (the A-type hardness meter (JA type)) complying with the standard of JIS K 6301 was 78 Hs.

TABLE 4

| | Brush biting amount [mm] | | | | | |
|---|---|---|---|---|---|---|
| | 1.0 | 1.3 | 1.5 | 2.5 | 3.0 | 3.5 |
| Belt shaving | No | No | No | No | Yes | Yes |
| Transfer blurring | No | No | No | No | Yes | Yes |

As shown in Table 4, it is seen that, when the amount of biting of the transfer brush 20 into the paper conveyor belt 11 was equal to or smaller than 2.5 millimeters, shaving of the rear surface of the paper conveyor belt 11 due to rubbing against the transfer brush 20 did not occur and, as a result, transfer blurring did not occur either. Thus, in the printer according to the fourth embodiment, an amount of biting of the brush unit of the transfer brush 20 into the paper conveyor belt 11 is set to a value equal to or smaller than 2.5 millimeters.

A printer according to a fifth embodiment of the present invention has the same constitution as the printer according to the first embodiment unless specifically noted otherwise.

In a fifth experiment, the inventor prepared a plurality of kinds of paper conveyor belts with different degrees of hardness of the rear surface side as the paper conveyor belts 11 set in the printer test machine. With each of the paper conveyor belts 11, the inventor printed out the test image on 100,000 pieces of transfer paper in a state in which the paper conveyor belt 11 was set in the printer test machine. Then, the inventor removed the paper conveyor belt 11 from the printer test machine and visually checked whether shaving due to rubbing against the transfer brush 20 on the rear surface occurred. By way of precaution, the inventor checked whether shavings of the rear surface of the paper conveyor belt 11 adhered to the tip of the transfer brush 20. The inventor also checked whether transfer blurring occurred in a printout image. A result of the experiment is shown in Table 5 below. Hardness of the rear surface side of the paper conveyor belt 11 was measured by the spring type JIS hardness meter (the A-type hardness meter (JA type)) complying with the standard of JIS K 6301. A transfer brush with the pile length t1 set to 5.8 millimeters was used as the transfer brush 20. The output of the test image was performed under the L/L environment (the environment of 10° C. and 15% RH) in which a bristle inclination amount described later is relatively small.

TABLE 5

| | Belt rear surface side hardness [Hs] | | | | | |
|---|---|---|---|---|---|---|
| | 75 | 76 | 77 | 78 | 79 | 80 |
| Belt shaving | No | No | No | No | Yes | Yes |
| Transfer blurring | No | No | No | No | Yes | Yes |

As shown in Table 5, it is seen that, when the hardness of the rear surface side of the paper conveyor belt 11 was equal to or smaller than 78 Hs, shaving of the rear surface of the paper conveyor belt 11 due to rubbing against the transfer brush 20 did not occur and, as a result, transfer blurring did not occur either. Thus, in the printer according to the fifth embodiment, a paper conveyor belt with hardness of the rear surface side equal to or smaller than 78 Hs is used as the paper conveyor belt A printer according to a sixth embodiment of the present invention has the same constitution as the printer according to the first embodiment unless specifically noted otherwise.

In a sixth experiment, the inventor prepared a plurality of kinds of paper conveyor belts with different materials of the rear surface side as the paper conveyor belts 11 set in the printer test machine. The inventor measured a coefficient of static friction of the rear surface of each of the paper conveyor belts 11. The measurement was performed by a measuring device called HEIDON Tribogear (type 94i: manufactured by Toshin Scientific Co., Ltd.). The measuring device can calculate a coefficient of static friction generated between a slider (brass, hard chrome finishing, 40 grams) of the measuring device and the rear surface of the paper conveyor belt 11, which is an object of measurement, based on a generated thrust at the time when a thrust in a horizontal direction is applied to the object of measurement rather than a general gradient method. In general, a coefficient of static friction of an object is high in a low-temperature and low-humidity environment and high in a high-temperature and high-humidity environment. Thus, in the sixth experiment, an environment in a laboratory was set as 23° C. and 50% RH. After leaving the paper conveyor belt 11 for twelve hours under this environment, the inventor measured a coefficient of static friction. As repeatedly described above, the rear surface of the paper conveyor belt 11 refers to a belt loop inner peripheral surface, which is a surface on exactly the opposite side of the belt front surface that holds transfer paper. A paper conveyor belt, the rear surface of which was made of a rubber material, was used as the paper conveyor belt 11. However, a paper conveyor belt not made of a rubber material may be used.

For each of the paper conveyor belts 11 prepared, after printing the test image on 100,000 pieces of transfer paper in a state in which the paper conveyor belt 11 was set in the printer test machine, the inventor removed the paper conveyor belt 11 from the printer test machine and visually checked whether shaving due to rubbing against the transfer brush 20 on the rear surface thereof occurred. By way of precaution, the inventor checked whether shavings of the rear surface of the paper conveyor belt 11 adhered to the tip of the transfer brush 20. The inventor also checked whether transfer blurring occurred in a printout image. A result of the experiment is shown in Table 6 below. The output of the test image was performed under the L/L environment (the environment of 10° C. and 15% RH) in which a bristle inclination amount described later is relatively small.

TABLE 6

| | Coefficient of static friction of belt rear surface | | | | | |
|---|---|---|---|---|---|---|
| | 0.50 | 0.65 | 0.70 | 0.75 | 0.80 | 0.95 |
| Belt shaving | No | No | No | No | Yes | Yes |
| Transfer blurring | No | No | No | No | Yes | Yes |

As shown in Table 6, it is seen that, when the coefficient of static friction of the rear surface of the paper conveyor belt 11 was equal to or smaller than 0.75, shaving of the rear surface of the paper conveyor belt 11 due to rubbing against the transfer brush 20 did not occur and, as a result, transfer blurring did not occur either. Thus, in the printer according to the sixth embodiment, a paper conveyor belt with a coefficient of static friction of the rear surface equal to or smaller than 0.75 is used as the paper conveyor belt 11.

A printer according to a seventh embodiment of the present invention has the same constitution as the printer according to the first embodiment unless specifically noted otherwise.

Figure 7:
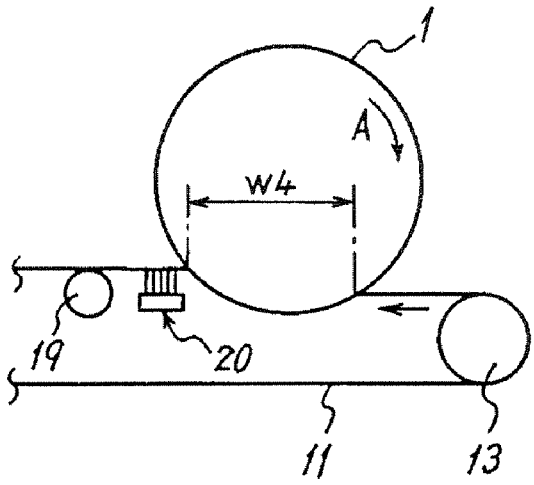
FIG. 7 is an enlarged diagram of a photosensitive member of a printer according to a seventh embodiment of the present invention and a constitution around the photosensitive member.
Figure 8:
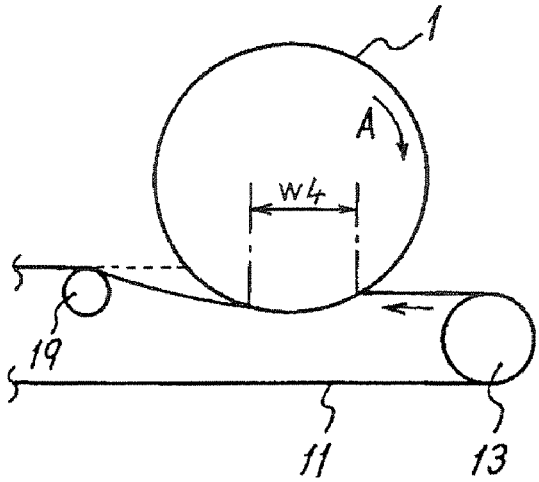
FIG. 8 is an enlarged diagram of the photosensitive member in the printer and the constitution around the photosensitive member at the time when a transfer brush is removed.

FIG. 7 is an enlarged diagram of the photosensitive member 1 of the printer according to the seventh embodiment and a constitution around the photosensitive member 1. In the figure, the transfer brush 20 in contact with the rear surface of the paper conveyor belt 11 presses the paper conveyor belt 11 to the photosensitive member 1 to increase a transfer nip pressure, which is a contact pressure between the paper conveyor belt 11 and the photosensitive member 1, compared with a transfer nip pressure at the time when the transfer brush 20 is not provided. For reference only, a state in which the transfer brush 20 is removed is shown in FIG. 8. When the transfer brush 20 is removed, a belt upper stretching and suspending surface near the photosensitive member 1 is lower than that in FIG. 7. Consequently, a transfer nip length W4, which is length of contact in the belt moving direction between the photosensitive member 1 and the paper conveyor belt 11, is smaller than that in FIG. 7 and the transfer nip pressure falls. The same applies to the printer according to the first embodiment shown in FIG. 1.

In a seventh experiment, in the printer test machine including the constitution shown in FIG. 7, the inventor adjusted attachment position in a vertical direction of the transfer brush 20 to set a transfer nip pressure to various values. A method of measuring the transfer nip pressure is as described below. First, a sheet-like measuring unit of a surface pressure measuring device (I-SCAN 5025 system) is placed on the paper conveyor belt 11 in a state in which the transfer device 10 is separated from the photosensitive member 1. Subsequently, the transfer device is set in an original position. The sheet-like measuring unit of the surface pressure measuring device is placed between the photosensitive member 1 and the paper conveyor belt 11. In this state, a contact area between the paper conveyor belt 11 and the photosensitive member 1 is calculated. Force acting on the sheet-like measuring unit is measured. A transfer nip pressure is calculated based on the contact area and a result of the measurement of force by the surface pressure measuring device. In the experiment, for one brush attaching position, a transfer nip pressure (F) in a position 70 millimeters to the center from one end in the width direction of the paper conveyor belt 11, a transfer nip pressure (C) in a center position in the width direction, and a transfer nip pressure (R) in a position 70 millimeters to the center from the other end in the width direction were measured. A transfer brush with a brush density of 120 KF is used as the transfer brush 20.

Figure 9:
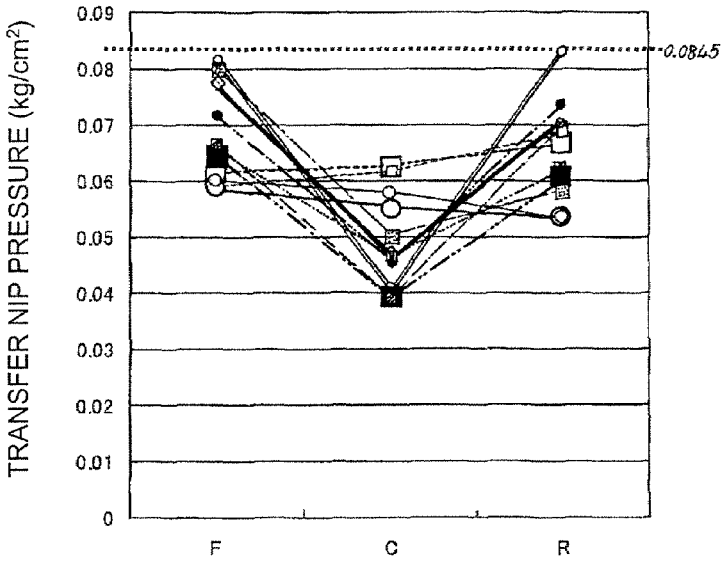
FIG. 9 is a graph of an example of a measurement result of a transfer nip pressure.

FIG. 9 is a graph of an example of a result of measuring a transfer nip pressure. As shown in the figure, in general, a transfer nip pressure is higher at both ends (F and R) in the belt width direction than in the center (C). This is because the center of the transfer brush 20 slightly bends.

Under the condition of the respective brush attaching positions (synonymous with transfer nip pressures), after printing out the test image on 100,000 pieces of transfer paper in each of the brush attaching positions, the inventor removed the paper conveyor belt 11 from the printer test machine and visually checked whether shaving due to rubbing against the transfer brush 20 occurred. By way of precaution, the inventor checked whether shavings of the rear surface of the paper conveyor belt 11 adhered to the tip of the transfer brush 20. The inventor also checked whether transfer blurring occurred in a printout image. A result of the experiment is shown in Table 7 below.

TABLE 7

| | Transfer nip pressure [kg/cm$^2$] | | | | | |
|---|---|---|---|---|---|---|
| | 0.040 | 0.055 | 0.070 | 0.090 | 0.095 | 0.100 |
| Belt shaving | No | No | No | No | Yes | Yes |
| Transfer blurring | No | No | No | No | Yes | Yes |

As shown in Table 7, it is seen that, when the transfer nip pressure was equal to or lower than 0.090 kg/cm$^2$, shaving of the rear surface of the paper conveyor belt 11 due to rubbing against the transfer brush 20 did not occur and, as a result, transfer blurring did not occur either. Thus, in the printer according to the seventh embodiment, a transfer nip pressure is set to a value equal to or lower than 0.090× gravitational acceleration G N/cm$^2$. The gravitational acceleration G is 9.80665.

Figure 10:
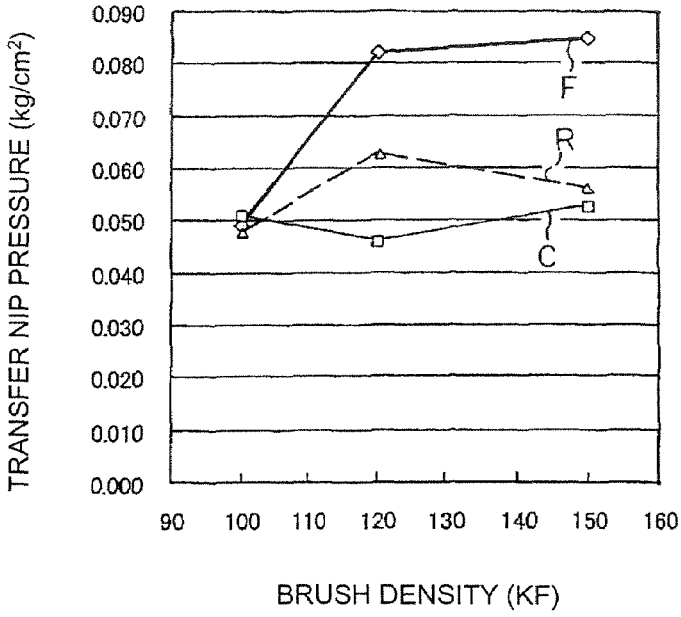
FIG. 10 is a graph of a relation between a brush density of the transfer brush and a transfer nip pressure.

In the seventh experiment, a transfer brush with a brush density of 120 KF was used as the transfer brush 20. However, for reference only, transfer nip pressures at brush densities of 80 KF and 150 KF are shown in FIG. 10.

It is important to set the pile length t1 of the transfer brush 20 to a value at which a target transfer nip pressure is obtained. When the pile length t1 is too large, shaving due to rubbing between the rubber material of the rear surface of the paper conveyor belt 11 and the brush unit of the transfer brush 20 is aggravated. Thus, attention should be paid to control the pile length t1.

For reference only, properties of nylon 6 (a product name) and rayon are shown in Table 8 below.

TABLE 8

| Conductive material Structure | | Material | | | | |
|---|---|---|---|---|---|---|
| | | Nylon 6 Carbon Distributed type | | | Rayon Carbon Distributed type | |
| Fineness | DT/F | 330/48 | 220/96 | 220/192 | 330/100 | 660/100 |
| Single yarn | DT | 6.9 | 2.3 | 1.1 | 3.3 | 6.6 |
| Diameter | □□m | ϕ27 | ϕ15 | ϕ11 | ϕ16 | ϕ23 |
| Specific gravity | | 1.26 | | | 1.57 | |
| Melting point | | 220° C. | | | — | |
| Softening point | | 190° C. | | | — | |
| Tensile strength | cN/dt | 1.1~1.3 | | | 0.8~0.9 | |
| Young's modulus | cN/mm2 | 900~1000 | | | 3200 | |
| Moisture content | 20° C. 50% RH | 4.50% | | | 12.3%~25% | |
| | 20° C. 65% RH | 3.5~5.0% | | | — | |
| | 20° C. 95% RH | 8.0~9.0% | | | — | |

It is seen from Table 8 that, in the transfer brush 20 of nylon, a moisture content of raised bristles is equal to or lower than 90% under the environment of 20° C. and 95% RH. On the other hand, in the transfer brush 20 of rayon, a moisture content of raised bristles is about 12.3% to 25% under the environment of 20° C. and 95% RH. It is seen that nylon is a material with a low moisture content compared with rayon.

Various properties of nylon 6 and nylon 12 are shown in FIG. 11. Nylon 6 is a material in which carbon is uniformly distributed in a sectional direction thereof. Nylon 12 is a material in which carbon is distributed only around the periphery in a sectional direction thereof.

The printer that transfers a toner image on the photosensitive member 1 onto transfer paper held on the front surface of the paper conveyor belt serving as a belt member has been explained. However, it is also possible to apply the present invention to a printer that transfers a toner image on the photosensitive member 1 onto an intermediate transfer belt serving as a belt member.

The inventor has found, through the experiments, that it is possible to control shaving of the rear surface of the belt member due to rubbing against the brush member by using, as the brush member, a brush member with length of raised bristles on the surface of the conductive support member equal to or smaller than 5.8 millimeters. Thus, in the brush member it is possible to control shaving of the rear surface of the belt member and control occurrence of transfer blurring due to accumulation of shavings of the belt member on the tip of the brush member.

The inventor has also found, through the experiments, that it is possible to control shaving of the rear surface of the belt member due to rubbing against the brush member by using, as the brush member such as the transfer brush, a brush member with a maximum bristle inclination amount of the raised bristles in the brush unit equal to or smaller than 0.53 millimeter. Thus, in the brush member it is also possible to control shaving of the rear surface of the belt member and control occurrence of transfer blurring due to accumulation of shavings of the belt member on the tip of the brush member.

The inventor has also found, through the experiments, that it is possible to control shaving of the rear surface of the belt member due to rubbing against the brush member by using, as the brush member, a brush member with a maximum bristle inclination return amount of the raised bristles in the brush unit equal to or smaller than 0.30 millimeter. Thus, in the brush member it is also possible to control shaving of the rear surface of the belt member and control occurrence of transfer blurring due to accumulation of shavings of the belt member on the tip of the brush member.

The inventor has also found, through the experiments, that it is possible to control shaving of the rear surface of the belt member due to rubbing against the brush member by reducing an amount of biting into the belt member in the brush unit of the brush member to a value equal to or smaller than 2.5 millimeters. Thus, in the brush member it is also possible to control shaving of the rear surface of the belt member and control occurrence of transfer blurring due to accumulation of shavings of the belt member on the tip of the brush member.

The inventor has also found, through the experiments, that it is possible to control shaving of the rear surface of the belt member due to rubbing against the brush member by using, as the belt member, a belt member with hardness of the rear side, which is a side of the surface in contact with the brush member, equal to or lower than 78 Hs. Thus, in the brush member it is also possible to control shaving of the rear surface of the belt member and control occurrence of transfer blurring due to accumulation of shavings of the belt member on the tip of the brush member.

The inventor has also found, through the experiments, that it is possible to control shaving of the rear surface of the belt member due to rubbing against the brush member by using, as the belt member, a belt member with a coefficient of static friction of the rear surface, which is the surface in contact with the brush member, equal to or lower than 0.75. Thus, in the brush member it is also possible to control shaving of the rear surface of the belt member and control occurrence of transfer blurring due to accumulation of shavings of the belt member on the tip of the brush member.

The inventor has also found, through the experiments, that, in the constitution for pressing the belt member to the image bearing member with the brush member to increase a contact pressure between the belt member and the latent image bearing member, it is possible to control shaving of the rear surface of the belt member due to rubbing against the brush member by setting the contact pressure between the latent image bearing member and the belt member to a value equal to or lower than 0.090×gravitational acceleration G N/cm$^2$. Thus, it is also possible to control shaving of the rear surface of the belt member and control occurrence of transfer blurring due to accumulation of shavings of the belt member on the tip of the brush member.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device comprising:

a belt device that endlessly moves a belt member of an endless shape while stretching and suspending the belt member with a plurality of stretching and suspending members; and a brush member disposed to bring a tip side of a brush unit including a plurality of raised bristles vertically provided on a surface of a conductive support member into contact with a rear surface of the belt member, the transfer device transferring a visible image on a surface of a latent image bearing member in contact with a front surface of the belt member onto the front surface of the belt member or a transfer material held on the front surface of the belt member while leading a transfer bias applied to the conductive support member from the tip side of the brush unit to the rear surface of the belt member, wherein, a maximum bristle inclination amount of the raised bristles is equal to or smaller than 0.53 millimeters.

2. The transfer device according to claim 1, wherein a length of the raised bristles on the surface of the conductive support member is equal to or smaller than 5.8 millimeters.

3. The transfer device according to claim 1, wherein a maximum bristle inclination return amount of the raised bristles in the brush unit is equal to or smaller than 0.30 millimeters.

4. A transfer device comprising:

a belt device that endlessly moves a belt member of an endless shape while stretching and suspending the belt member with a plurality of stretching and suspending members; and a brush member disposed to bring a tip side of a brush unit including a plurality of raised bristles vertically provided on a surface of a conductive support member into contact with a rear surface of the belt member, the transfer device transferring a visible image on a surface of a latent image bearing member in contact with a front surface of the belt member onto the front surface of the belt member or a transfer material held on the front surface of the belt member while leading a transfer bias applied to the conductive support member from the tip side of the brush unit to the rear surface of the belt member, wherein a maximum bristle inclination return amount of the raised bristles in the brush unit is equal to or smaller than 0.30 millimeters.

5. The transfer device according to claim 4, wherein an amount of biting into the belt member in the brush unit of the brush member is set to a value equal to or smaller than 2.5 millimeters.

6. The transfer device according to claim 4, wherein a hardness of a rear surface side of the belt member is equal to or lower than 78 Hs.

7. The transfer device according to claim 4, wherein a coefficient of static friction on the rear surface of the belt member is equal to or smaller than 0.75.

8. An image forming apparatus comprising:

a latent image bearing member that bears a latent image on an endlessly moving surface thereof;

a latent image forming unit that forms a latent image on the surface;

a developing unit that develops a latent image on the surface; and a transfer device that transfers a visible image obtained by development to a front surface of the endlessly moving belt member or a transfer material held on the front surface, the transfer device including:

a belt device that endlessly moves the belt member while stretching and suspending the belt member with a plurality of stretching and suspending members; and a brush member disposed to bring a tip side of a brush unit including a plurality of raised bristles vertically provided on a surface of a conductive support member into contact with a rear surface, of the belt member, and the transfer device transferring a visible image on a surface of a latent image bearing member in contact with the front surface of the belt member onto the front surface of the belt member or a transfer material held on the front surface of the belt member while leading a transfer bias applied to the conductive support member from the tip side of the brush unit to the rear surface of the belt member, wherein a maximum bristle inclination amount of the raised bristles is equal to or smaller than 0.53 millimeters.

9. The image forming apparatus according to claim 8, wherein a length of the raised bristles on the surface of the conductive support member within the transfer device is equal to or smaller than 5.8 millimeters.

10. The transfer device according to claim 8, wherein a maximum bristle inclination return amount of the raised bristles in the brush unit within the transfer device is equal to or smaller than 0.30 millimeters.

11. The image forming apparatus according to claim 8, wherein an amount of biting into the belt member in the brush unit of the brush member is set to a value equal to or smaller than 2.5 millimeters.

12. The image forming apparatus according to claim 8, wherein a hardness of a rear surface side of the belt member is equal to or lower than 78 Hs.

13. The image forming apparatus according to claim 8, wherein a coefficient of static friction on a rear surface of the belt member is equal to or smaller than 0.75.

14. The image forming apparatus according to claim 8, wherein the belt member is pressed to the latent image bearing member by the brush member to increase a contact pressure between the belt member and the latent image bearing member compared with a contact pressure at the time when the brush member is not disposed, and the contact pressure between the belt member and the latent image bearing member is set to a value equal to or lower than 0.090×gravitational acceleration G $N/cm^2$.

15. An image forming apparatus comprising:

a latent image bearing member that bears a latent image on an endlessly moving surface thereof;

a latent image forming unit that forms a latent image on the surface;

a developing unit that develops a latent image on the surface; and a transfer device that transfers a visible image obtained by development to a front surface of the endlessly moving belt member or a transfer material held on the front surface, the transfer device including:

a belt device that endlessly moves the belt member while stretching and suspending the belt member with a plurality of stretching and suspending members; and a brush member disposed to bring a tip side of a brush unit including a plurality of raised bristles vertically provided on a surface of a conductive support member into contact with a rear surface of the belt member, and the transfer device transferring a visible image on a surface of a latent image bearing member in contact with the front surface of the belt member onto the front surface of the belt member or a transfer material held on the front surface of the belt member while leading a transfer bias applied to the conductive support member from the tip side of the brush unit to the rear surface of the belt member, wherein a maximum bristle inclination return amount of the raised bristles in the brush unit is equal to or smaller than 0.30 millimeters.

* * * * *